United States Patent [19]

Blessing, Sr.

[11] Patent Number: 4,576,354

[45] Date of Patent: Mar. 18, 1986

[54] PANEL OVERHEAD SUPPORT APPARATUS

[76] Inventor: William R. Blessing, Sr., 95 Saddle Mountain Rd., Colorado Springs, Colo. 80919

[21] Appl. No.: 620,557

[22] Filed: Jun. 14, 1984

[51] Int. Cl.[4] ..... B25J 3/00

[52] U.S. Cl. ..... 248/354.5; 52/632; 52/749; 248/351; 182/178; 182/179

[58] Field of Search ..... 52/113, 637, 638, 749, 52/750, 632; 248/354.4, 354.5, 354.1, 351, 354.6; 182/178, 179

[56] References Cited

U.S. PATENT DOCUMENTS

| | | | |
|---|---|---|---|
| 2,273,813 | 2/1942 | Barber | 248/354.4 X |
| 2,413,342 | 12/1946 | Symons | 248/354.5 |
| 2,583,945 | 1/1952 | Jacobs | 248/354.1 X |
| 2,820,626 | 1/1958 | Hedeen | 248/354.5 X |
| 2,858,094 | 10/1958 | Olson | 248/354.1 X |
| 2,937,842 | 5/1960 | Meek | 248/354.5 |
| 3,701,544 | 10/1972 | Stankovich | 248/354.4 X |
| 3,836,174 | 9/1974 | Holman, Jr. | 248/354.5 X |
| 3,930,645 | 1/1976 | Anderson | 248/354.1 X |

FOREIGN PATENT DOCUMENTS

| | | | |
|---|---|---|---|
| 496737 | 8/1954 | Italy | 248/354.6 |

*Primary Examiner*—Carl D. Friedman
*Assistant Examiner*—Richard Chilcot, Jr.
*Attorney, Agent, or Firm*—Ronald Charles Williams

[57] ABSTRACT

A panel support column for supporting sheet rock panels in an overhead position during the fixed mounting of the sheet rock panels to a ceiling. The panel support column is comprised of a broad flat bearing plate, rotatably attached to a circular cross section support rod, a support barrel having a cavity which closely accepts the support rod for reciprocative movement, an upper and a lower retaining clamp, a compression spring mounted around the juncture of the support rod and support barrel, and an non-slip end cup on the lower end of the support barrel. The support rod has a plurality of height adjusting holes to which the upper clamp can be attached so as to allow adjustment of the height of the panel support column to accommodate ceilings of different heights. In operation, the support column is adjusted to a length greater than the floor-to-ceiling height so that the support rod can be manually urged into the support barrel, the support column then positioned under the panel to be supported, thereafter allowing the compression spring to urge the support rod out of the support barrel to support the panel in place.

1 Claim, 1 Drawing Figure

PANEL OVERHEAD SUPPORT APPARATUS

BACKGROUND OF THE INVENTION

The disclosed invention relates to the field of workpiece handling and support, and in particular to the overhead support and mounting of thin, flat workpieces such as sheet rock to a ceiling.

In the construction industry, both walls and ceilings are covered with flat, broad coverings having a smooth exposed surface. A prime example is sheet rock. In the past, sheet rock has been attached to the ceiling joists using a crew of workers who would manually lift the sheet rock into an overhead position, and hold it in place while it is nailed or otherwise secured to the ceiling. Sheet rock is quite dense. Since the panels generally come in sheets four feet by eight feet (4'×8'), the panels are rather heavy and difficult to manipulate. While a two-man crew could mount ceiling panels, in most instances, a crew of at least three workers has generally been required. Two workers are necessary to lift and hold the panel in place, while a third secures the sheet rock to the ceiling. Mounting the sheet rock by this method is very strenuous and difficult work. Also it is not a particularly efficient procedure.

An additional problem with the manual lift and support procedure, is that the precise placement of the panel is most difficult. This is because it is difficult to manually hold the panel overhead against the ceiling while an attempt is made to precisely shift the panel into place. However, precise positioning of the panel is necessary for a professional looking finished product. Despite the problems associated with mounting sheet rock panels, the prior art has not specifically developed mechanical aids which can assist in holding the panel in place against the ceiling during fastening in place, but will also allow the panel position to be adjusted prior to being secured to the ceiling.

What is needed then is a mechanical aid for assisting workers in raising a sheet rock panel into place and thereafter holding the sheet rock panel in place while is it precisely positioned and permanently fixed to the ceiling joist.

Accordingly, it is the object of this invention to provide a means for holding a workpiece in position while the workpiece is attached to a fixture.

It is another object of the disclosed invention to provide a means for allowing the position of the workpiece to be precisely aligned while being held in place, prior to attachment to the fixture.

BRIEF SUMMARY OF THE INVENTION

The present invention, a panel support column, provides a means for helping to raise a sheet rock panel into place in an overhead position for mounting to a ceiling, and thereafter retaining the panel in place as the panel is nailed or otherwise fastened in place. The disclosed invention also provides a means which allows the panel position to be precisely adjusted prior to being fixed to the ceiling.

The present invention is an improvement over the prior practice in that the panel support column allows a two man crew to rapidly and efficiently mount sheet rock panels to a ceiling, while also allowing for a much tighter and precise fit between panels. This invention also will allow a single worker, of sufficient strength and in the appropriate circumstances, to be able to mount sheet rock panels unassisted, and to thereafter be able to precisely fit the panels together for a professional looking finish.

This is accomplished by providing a spring loaded reciprocative panel support column which, when placed into position under the approximate center of the panel, mechanically retains the panel in place. Once in place, the panel support column allows the panel position to be adjusted for a precise fit. In the preferred embodiment, the panel support column is comprised of: a load bearing support plate; an adjustable length support rod; a tubular support barrel; an upper, adjustable spring retaining clamp; a lower, fixed spring retaining clamp; a helical compression spring, which is mounted around the support rod and the support barrel between the upper and lower spring retaining clamps, and; a non-slip end cap located on the lower end of the support barrel.

In the preferred embodiment, the load bearing plate is a broad flat plate rotatably attached to the upper end of the support rod. This load bearing plate allows support of the weight of the panel without causing surface damage thereto. The load bearing plate is rotatably attached to the upper end of the support rod in order to facilitate the tilting of the panel support column with respect to the panel as the panel support column is moved into position under the panel.

The support rod has a circular cross section and slides into a cavity for that purpose in the tubular shaped support barrel. Thus, the support rod and the support barrel can reciprocatively slide with respect to one another. The fixed and adjustable spring retainer clamps are positioned such that when the panel support column is fully extended by the spring, the panel support column length is greater than the ceiling-to-floor height. Thus, when the panel support column is in place, the compression spring will forcefully urge the support rod out of the support barrel to fully support the panel in place on the ceiling.

In the preferred embodiment, the overall length of the panel support column can be adjusted to accommodate a plurality of different ceiling heights. This is accomplished by means of a series of equally spaced holes in the support rod which cooperate with the adjustable spring retainer clamp to allow the support rod to extend out of the support barrel a length that will make the overall panel support column length slightly greater than the overall ceiling-to-floor distance.

In operation, the panel is raised into place by manual means, or when the ceiling is to high, by a plurality of panel support columns. The load bearing plate is then placed in the approximate center of the panel with the support rod manually forced into the support barrel. Thereafter, the spring forces the panel support column toward an open position, thereby supporting the panel in place. Once in place, the panel position can be laterally adjusted for a precise fit against the other panels.

DETAILED DESCRIPTION OF THE PREFERRED EMBODIMENT

Figure 1:
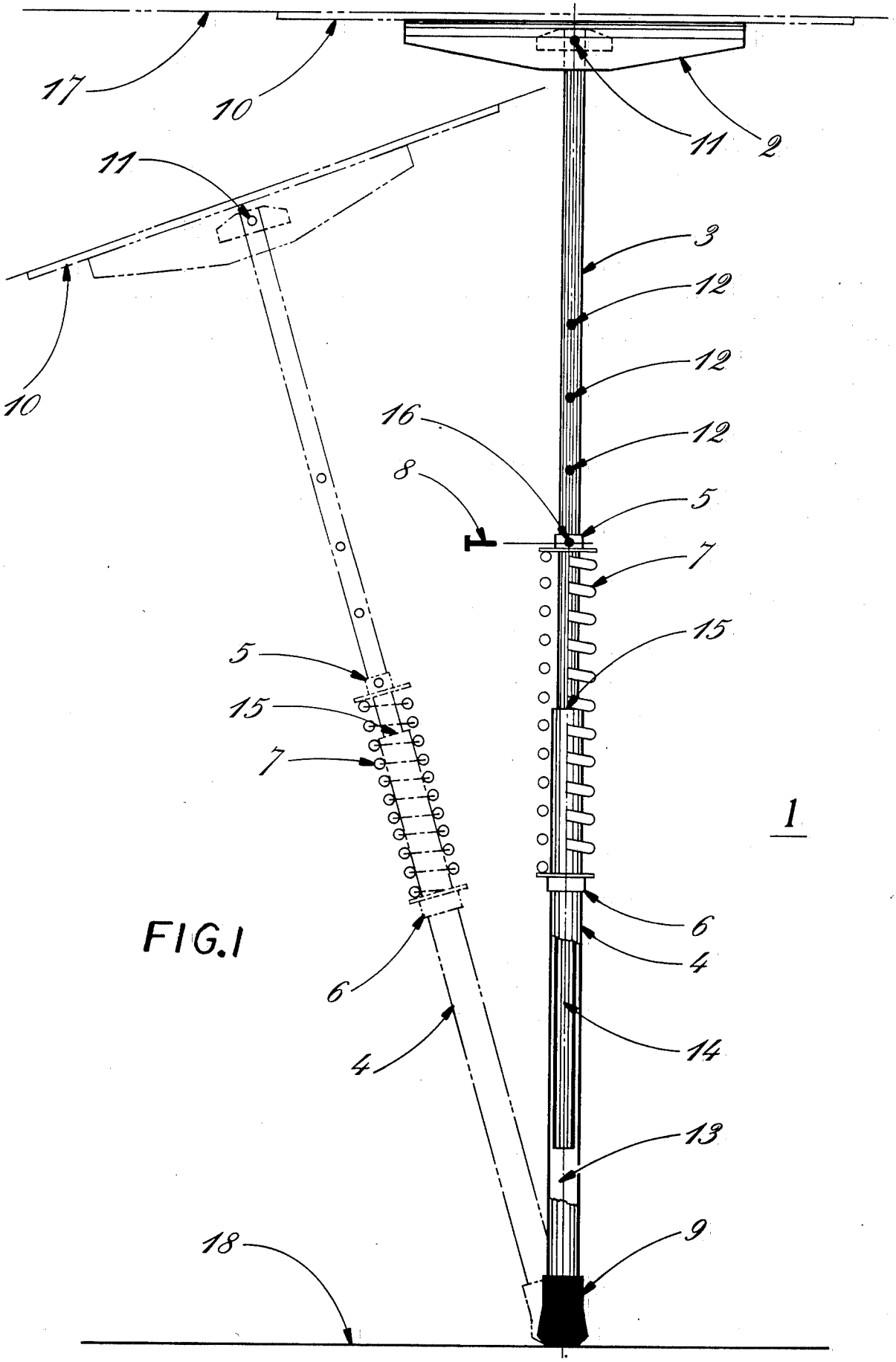
FIG. 1 is a partial breakaway pictorial representation showing the preferred embodiment of the disclosed invention, a panel support column, in a first, tilted position and a second, fully supporting position, perpendicular to the ceiling.

As shown in FIG. 1, in the preferred embodiment, the invention, a panel support column 1, is comprised of a load bearing support plate 2, a support rod 3, a support barrel 4, an upper spring retaining clamp 5, a lower spring retaining clamp 6, a helical compression spring 7, a column length/height adjusting pin 8, and a non-slip end cup 9.

In the preferred embodiment, the load bearing support plate 2 has a broad upper flat surface for evenly contacting the lower surface of the sheet rock panel 10. This allows the panel 10 to be held in place without damaging the exposed surface of the panel 10. The load bearing plate 2 is rotatably attached to the upper end 11 of the support rod 3 in order to allow the panel support column 1 to be tilted relative to the panel 10 and still allow the load bearing plate 2 to remain flush against the lower surface of the panel 10.

The support rod 3 has a circular cross section. In the preferred embodiment, the support rod 3 has a plurality of evenly spaced holes 12 which accept the column length/height adjusting pin 8, which allows the adjustment of the overall length of the panel support column 1 so as to accommodate a plurality of different ceiling heights.

The tubular shaped support barrel 4, has a cavity 13 of a diameter sufficient to closely receive the lower end 14 of the reciprocating support rod 3. The helical compression spring 7 is disposed around the junction 15 where the support rod 3 enters the support barrel 4, and is held in place between the upper and the lower spring retaining clamps 5 and 6. In the preferred embodiment, the spring 7 provides enough force to fully support the weight of the sheet rock panel 10, but not so great as to prevent a worker from being able to manually compress the spring 7 during panel column support 1 placement.

The lower spring retaining clamp 6 is fixed to the support barrel 4. The upper spring retaining clamp 5 has a passage 16 which allows the retaining pin 8 to pass so as to engage any one of the plurality of holes 12 in the support rod 3. Thus, the overall lenght of the panel support column 1 can be adjusted by removing the pin 8, and moving the appropriate hole 12 in the support rod 3 even with the passage 16 in the adjustable spring retaining clamp 5, thereafter inserting the retaining pin 8 through the passage 16 in the spring retaining clamp 5 into the support rod 3, to secure the adjustable spring retaining clamp 5 to the support rod 6. Thus, when the panel support column 1 is adjusted to a length greater than the floor-to-ceiling height, the worker can manually push the support rod 3 down further into the support barrel 4, compressing the spring 7 and thereby providing a counterforce that, when the panel support column 1 is properly in place under a panel 10, the spring 7 will push the load bearing plate 2 up against the panel 10. The panel 10 is then held in place between the ceiling 17 and the panel support column 1.

A non-slip cup 9 is placed on the lower end of the support barrel 4 in order to provide a non-slip contact for the panel support column 1 when it is in contact with the floor 18.

In operation, the panel support column 1 is adjusted to a length slightly greater than the floor-to-ceiling distance. The panel 10 is then lifted into place and located in the approximate mounting position. While one worker holds the panel 10 in place, the second worker tilts the panel support column 1, placing the bearing plate 2 in the approximate center of the panel 10. The lower end of the support column 1 is then moved to a straightened position perpendicular to the floor 18 under the center of the panel 10. The worker then releases either the support barrel 4 or the support rod 3, to allow the support rod 3 to move slightly out of the support barrel 4. Once in place, the spring 7 pushes the support rod 3 and the support barrel 4 apart, so that the panel support column 1 is fully supporting the panel 10 in place against the ceiling 17. Once centered, with the panel support column 1 supporting the weight of the panel 10, the workers can slide and adjust the panel 10 into the exact position desired. After the panel 10 is precisely placed, the panel 10 can be nailed or otherwise fastened to the ceiling 17.

With a single worker, the upper end of the panel support column 1 is placed on the worker's shoulder. The panel 10 is then tilted and lifted upward, placing one end in place on the ceiling 17. Then, the second end rotated upward to approximate position on the ceiling 17. Then, with one hand holding the panel 10 approximately in place, the other hand is used to move the load bearing plate 2 into contact with the bottom of the panel 10 in the approximate center of said panel 10. The worker can then raise the lower end of the panel support column 1 slightly off the floor 18 to position the panel support column 1 fully under the panel 10, thereafter allowing the panel support column 1 to extend to the floor 18 and support the panel 10 in place. Thereafter, the panel 10 can be adjusted and fastened into place as discussed above.

For ceiling heights above which that can normally be reached by a worker, a plurality of panel support columns 1 can be used to support a panel 10 while the panel 10 is being placed in position. For example, a panel support column 1 can be used on each corner of the panel 10.

While the disclosed invention has addressed the use of a spring loaded column support 1, it is to be understood that any means of providing a lifting force which will allow the reciprocative movement of the support rod 3 with respect to the support barrel 4, can be used, and in addition, fully automated means such as air pressure cylinders can be used to mechanically extend and retract the support rod 3 with respect to the support barrel 7 once properly placed.

Additionally, while the preferred embodiment has disclosed positioning of sheet rock panels 10 into overhead positions on ceilings, it is to be understood that the panel support column 1 can be used in a horizontal position, from a fixed support, as well as a vertical position, and spacings can support any type of workpiece to be mounted, and that the bearing plate 2 can be adapted to engage and retain any number of differently shaped workpieces to be supported.

I claim:

1. An apparatus for supporting workpieces in position during fixed attachment of the workpieces in position, said apparatus comprised of:

a load bearing support plate for flatly engaging and supporting the workpiece in position;

a support rod, said support rod having a circular cross section, having the support plate rotatably attached to the upper end thereof, and having the lower portion thereof disposed in a cavity, for that purpose, in a support barrel and further having a plurality of equally spaced holes for accepting an adjusting pin;

a support barrel, said barrel having a circular cross sectioned interior cavity of sufficient diameter as to closely accept the lower portion of the support rod, said support barrel having a non-slip means attached to the lower end thereof, and further having a means for the fixed attachment of a lower spring retaining clamp at the lower end thereof;

a helical compression spring, said spring having a diameter sufficient to be disposed around the lower end of the support rod and the upper end of the support barrel;

an upper spring retaining clamp, said upper clamp adjustably attached to the support rod, and having a means to retain the upper end of the spring, and further having a passage of diameter sufficient to allow passage of the adjusting pin;

a lower spring retaining clamp, said lower clamp fixedly attached to the outer diameter of the barrel, and having a flange which supports the lower end of the spring, said upper and lower retaining clamps positioned so as to cooperate with the spring to push the support rod out of the support barrel a distance sufficient to transmit a force through the rod to the support plate so as to hold the workpiece in position, and;

the adjusting pin for fastening the upper clamp in the appropriate hole in the support rod to extend the support rod out of the support barrel to the distance necessary to support the workpiece in position.

* * * * *